US006241598B1

(12) United States Patent
Kleissler, Jr.

(10) Patent No.: US 6,241,598 B1
(45) Date of Patent: Jun. 5, 2001

(54) DISPENSING STATION FOR CHEMICALS AND THE LIKE

(75) Inventor: Edwin A. Kleissler, Jr., Avon By The Sea, NJ (US)

(73) Assignee: Kleisser Company, Lakeland, FL (US)

( * ) Notice: Subject to any disclaimer, the term of this patent is extended or adjusted under 35 U.S.C. 154(b) by 0 days.

(21) Appl. No.: 09/131,126

(22) Filed: Aug. 7, 1998

(51) Int. Cl.[7] ..... B08B 15/02
(52) U.S. Cl. ..... 454/60; 454/187
(58) Field of Search ..... 454/56, 60, 187

(56) References Cited

U.S. PATENT DOCUMENTS 3,354,495 * 11/1967 Lawrence, III ..... 454/60 X

OTHER PUBLICATIONS

A. E. Porteous et al., "Clean Air Station", *IBM Technical Disclosure Bulletin,* vol. 13, No. 6, Nov. 1970, pp. 1437 and 1438.*

* cited by examiner

*Primary Examiner*—Harold Joyce

(57) ABSTRACT

Methods and apparatus for reducing contamination in a local work or dispensing station area. Whereby air flows through the operator's localized breathing area constantly, and therefore reduces or eliminates local eddying and pooling of contaminants.

2 Claims, 4 Drawing Sheets

DISPENSING STATION FOR CHEMICALS AND THE LIKE

BACKGROUND OF THE INVENTION

The present invention relates to dispensing stations for chemicals and the like. More particularly, it relates to methods and apparatus for providing a clean air working environment for operators who utilize or transfer chemicals and the like.

There is a great need to provide protection for these operators. Often, they work in local areas, known as dispensing or work stations, and care must be taken to keep the chemicals or other materials from airborne dispersion beyond the stations. Additionally, the operator must be protected from airborne dispersion of the material he or she is working with. For example, within the dispensing station there may be containers of chemicals and the like which are mixed with other chemicals, transferred to other containers, or loaded for transport. The mixing, transfer, weighing and/or loading operations, whether carried out manually or automatically, will create airborne particles against which the operator in the local station and other individuals in the environment must be protected.

One method of attempting to ensure operator safety is the use of contained suits, which provide their own breathing supply and apparatus. This provides local protection for the operator-he or she is totally isolated from the external environment. The use of these suits is cumbersome, however, and they are operator dependant, that is, the material cannot be manipulated, or in some cases the room where the transfer is occurring even entered, without a suit. Additionally, the material, whether chemical or other material, may simply not require the degree of protection that a contained suit provides. Thus, the use of a room planned around contained suit handling of materials may be unduly cumbersome for some materials.

Another alternative is the use of forced air circulating through the ceiling of the room in which the stations are located. This practice, often known as downflow, provides generalized protection to the room as whole. It lessens the chance of the room air below carrying airborne particles by developing an air pattern that directs the air toward exhaust panels.

This sort of generalized airflow, however, provides less than optimum protection. It fails to protect against local eddies or other local zones of recirculation that often carry airborne particles and occur within a dispensing station because of obstructions such as the operator's head and body or other causes such as operator movement. The local zones—with their attendant particle concentrations are especially of concern if they occur in the operator's breathing area, such as when the operator stands near the container or bends over the container when scooping materials from the container.

Therefore, it is an object of the present invention to provide methods and apparatus for the provision of local comfort zones in a dispensing station environment.

SUMMARY OF THE INVENTION

The present invention comprises method and apparatus for locally controlling and directing air flows about dispensing, work and other stations, and effectively providing local isolated zones by which airborne dispersion is kept to a minimum and away from the operator. These zoned air flows provide a localized breathing zone for the operator.

This localized breathing zone includes a "face wash" separately generated from the air generally circulating in the room, and usually will include a local exhaust. The face wash, in most embodiments, is combined with other local air flows circulating above and/or about the operator at the station, and in the preferred embodiments the face wash and the local exhaust maximizes the control of any air contamination.

In other embodiments, additional local isolation zones may be provided by the use of physical enclosures at the dispensing station. These enclosures, which may or may not be removed as needed, provide yet a further barrier from airborne material being dispersed. If, in certain embodiments, it is desired to recirculate the air being used, or to cleanse the air before being exhausted, filters may be used.

DETAILED DESCRIPTION OF THE PREFERRED EMBODIMENTS

Figure 1:
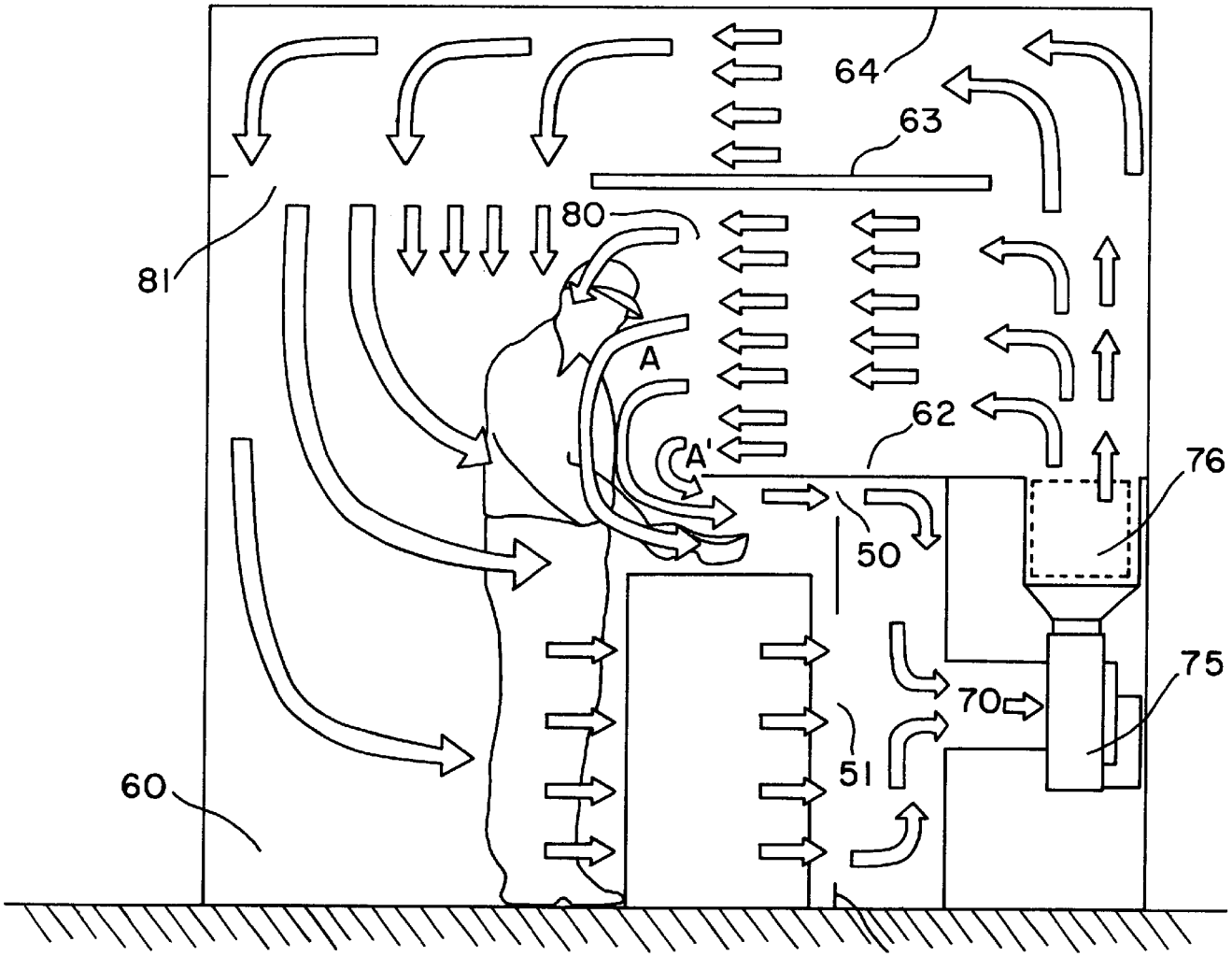
FIG. 1 is a view of a preferred embodiment.

FIG. 1 shows a preferred embodiment. Laminar air flows are shown generally throughout the embodiment. Two intakes 50 and 51 are seen in the back of wall 61. Intake 50 is the primary air intake. It acts to minimize the escape of any contaminated air by providing for an immediate take up of contaminated air existing above the container. That is, it is responsible for bringing in the majority of contaminated air created in the local zone A of FIG. 1, where the air is most heavily contaminated and most likely to be breathed by the operator.

Towards that end, intake 50 is preferably placed so that it creates a flow region, shown generally at A' that operates in a thin laminar layer about the end of duct floor 62. This layer, in tandem with the face wash area described below, operates to provide consistent cleansing and removal in the operator's localized breathing zone.

The intake 50 is only shown as a thin slot in this embodiment, extending across the entire back of a secondary wall 61. In this embodiment it is desirably offset no more than one-half inch from the rear of the container, and is further comprised of a local exhaust hood (not shown). If containers of various sizes are desired to be used in this embodiment, they are placed at about this distance, which is the preferred distance for this local exhaust zone.

Of course, in some embodiments other configurations may be used to effectively operate as a local exhaust, that is, to create a local exhaust zone, however, in the preferred embodiments the local exhaust is comprised of at least a local exhaust hood. In general, the provision of any intake or intakes which operate primarily in the most contaminated areas of the dispensing station is well within the sprit and scope of the present invention, as is the circulation of cleansed air throughout that area, whether in the form of a face wash or other localized area of air flow. The preferred embodiments use both local exhaust and a face wash to cleanse the localized breathing area of the operator. In especially preferred embodiments, the local exhaust takes the form of a local exhaust hood or hoods, which in tandem with a face wash effectively cleanses the localized breathing zone of the operator.

In some other embodiments, a face wash only, or face wash with a form of local exhaust, may be desired. The face wash is generally a air flow directed in the operator's localized breathing zone, in the area where the operator's face would be expected to be placed when he or she is manipulating the chemicals held in the containers of the work station.

For example, in some embodiments the intake or intakes may be adjustable vertically, that is, up and down, in some embodiments in order to ensure effective local exhaust. In other embodiments, horizontal or side to side movement of the intakes, separately or in conjunction with vertical movement of the intakes, might be desirable in order to maximize local exhaust.

There is a second intake 51 in FIG. 1, which provides for a general air flow moving past the operator and containers into the circulation area. The air flowing into the intakes 50 and 51 is then combined into duct 70, which carries the air to fan 75. The fan moves the air into a HEPA filter 76, where the contaminants are filtered from the air.

Once filtered, in this embodiment, the cleansed air is separated into two flow patterns and recirculated through the system. The first flow is output to create a face wash. This face wash is contained generally within the circulation area by a passage formed by the bottom of lower station roof 62, duct walls (not shown), and duct floor 63. The air exits out ventilator 80 into the operator's localized breathing area, and in front of the operator, in a generally laminar flow pattern, as shown by the arrows in FIG. 1.

The velocity of the face wash air is generally in the range of 125 to 250 fpm. This provides a minimally intrusive face wash. The velocity of the second air flow described in detail below is in the same range. It is preferred, in other embodiments, to have the face wash at about these velocities, however, is some other embodiments, a greater or lesser velocity may be desired.

The second air flow pattern proceeds generally by way of a passage formed by the top of lower station roof 63, a second set of duct walls (not shown), and upper station roof 64. This air flow exits out through ventilator 81 above and behind the operator, proceeds past the operator and containers, and is taken up primarily by intake 50, although it may also be taken up by intake 51.

The ventilators used in the various embodiments of the present invention may or may not have louvers or other devices known in the art to assist in maintaining an orderly flow of air, including devices known in the art to assist in maintaining the laminar flow pattern used in those embodiments. For example, a perforated metal facing may be used to also assist in the air flow.

Figure 2:
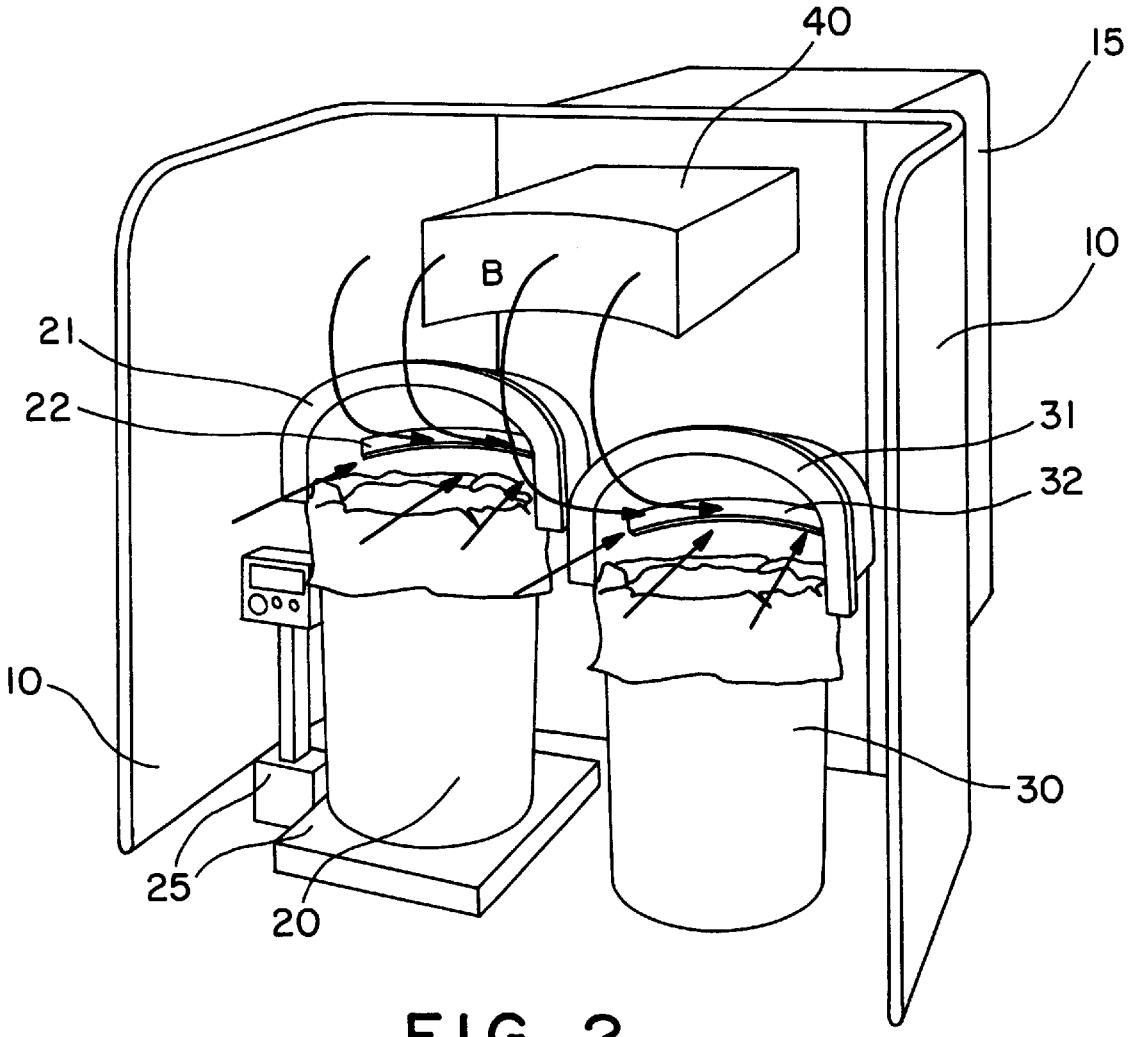
FIG. 2 is a cross sectional view of another preferred embodiment.

At FIG. 2 is shown another preferred embodiment. It has a U shaped wall 10 made of transparent, formed LEXAN®. The U shape permits use of side walls which isolate the area and thus further localize and control the airflow.

Two drums, 20 and 30 are seen by way of example. They are typical of the containers used in the transfer and/or dispensing of the chemicals and the like. The drum 30 contains the material which is being transferred from, and the drum 20 is the drum to which the material is being transferred to. The weigh scale 25 under drum 20 assists to ensure precision in the transfer. The amount transferred often may be judged by weight, or volume, (e.g. the operator has a specifically graduated scoop or other device) or by both weight and volume. Of course the number of drums or other types of containers present in the dispensing station used in the transfer and/or mixing of materials may vary.

Hoods 21 and 31 are located almost immediately above drums 20 and 30 respectively and are moveable or adjustable vertically for containers of different heights. So that, for example, a container is brought to the workstation and placed in position. The hood will then be lowered to created the local exhaust zone. Hoods 21 and 31 have intakes 22 and 32, respectively, which are in turn connected to exhaust ducts that are not shown in this embodiment, but which are described in greater detail below. This provides the local exhaust of this embodiment.

Ventilator 40 is seen projecting from the back of wall 10. It provides pressurized air flow, in the nature of a "face wash." As with the face wash of FIG. 1, this face wash provides clean air in the operator's face and breathing zone area. As shown by the arrows, the face wash air flow travels out through the ventilator 40, past the operator's face, and is drawn back into intakes 22 and 32, in manner explained more fully below. The velocity of the flow is, in this embodiment as was the case in FIG. 1, gentle enough to minimize detection by the operator, and thereby minimize any annoyance caused by a directed air flow. The velocity is in the range of 125 to 250 feet per minute (fpm) as measured about the area of the operator's face.

The exhaust of the flow, including the face wash, is into the intakes 22 and/or 32. These intakes are in the form of slots, cut into the hoods shown in this embodiment. In this embodiment, as in the embodiment of FIG. 1, it is preferred that a local exhaust be created immediately above the containers. In combination with the face wash, this local exhaust is effective in cleansing the air in zone B—the operator's localized breathing area. The air in this zone is of special concern because it is usually the most contaminated, being right above the open container, and is also the most likely to be inhaled by the operator, as it is the area the operator will primarily have his or her head in as he or she manipulates or transfers the material in the drums.

The hoods 21 and 31 are height adjustable so that they may be located almost immediately above containers of varying heights. Extending outwardly from the rear of the hoods in manner not shown are flexible ducts, which retain the contaminated air brought in through the intakes. The air passes into a recirculation area in the rear section shown generally at 15. Although the recirculation area is not shown in this figure, it is generally described, and operates in a similar manner to the recirculation area described above with regard to the embodiment shown in FIG. 1.

The air is drawn into the intakes 22 and 32, then into ducts which combine in the recirculation area into one duct. A fan in the single recirculation area duct draws the air. The fan may be any type known in the art which is able to provide the pressure desired, such as various models from manufactures such as Buffalo Forge, NY Blower or Twin Cities. In this and other embodiments described herein, the fan should be powerful enough to compensate for any pressure drop that occurs as the air passes through a filter or filters. In this embodiment, for example, the air leaves the fan and then passes through a HEPA filter, where the contaminated particles are removed. From the HEPA filter, the cleansed air passes through yet another duct which carries it to be expelled back into the dispensing station area via ventilator 40.

Figure 3:
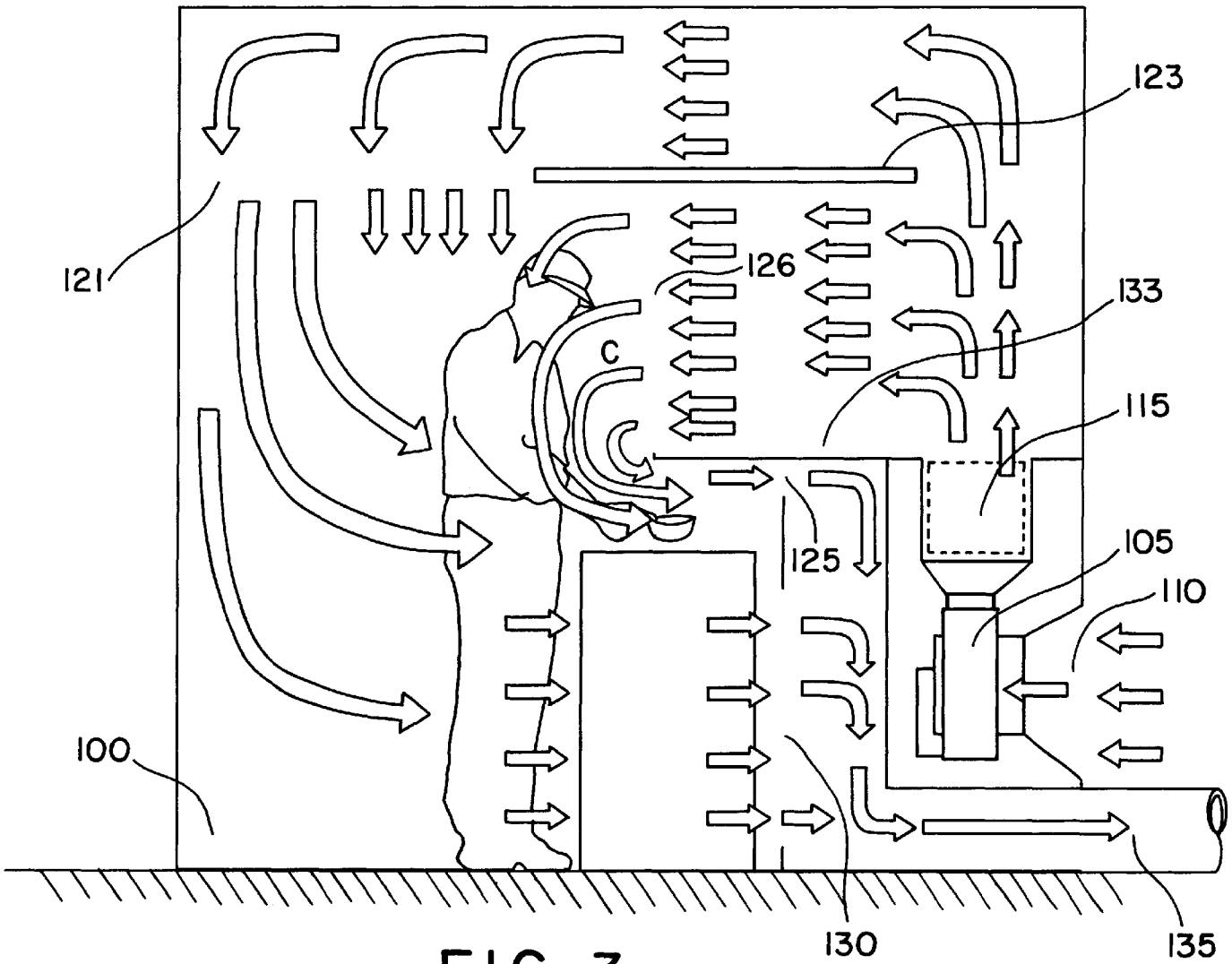
FIG. 3 is a cross sectional view of another preferred embodiment.

The embodiment shown in FIG. 3 has the contaminated air exhausted from the system, rather than recirculated. Fan

105 takes up the general room air by way of intake 110. The air moves past a HEPA filter 115 where it is separated into two flows, similar to the flows in FIG. 1. The air then flows generally through the dispensing station, and intakes 125 and 130 receive the contaminated air. The air is then combined into duct 135 which by way of a remote fan (not shown) exhausts the air from the station. This air may be treated by filtration, dust separation or other methods known in the art. It also may be desired to use a ventilation system that can be manipulated as desired, so that, for example, periodic exhaustions of the air could be achieved if desired, as well as recirculation.

In other respects, such as the local exhaust and face wash, this embodiment is essentially similar to the embodiment of FIG. 1. In yet another alternative embodiment, since the air shown in zone C—the operator's localized breathing area—of FIG. 3 is generally the most contaminated, and since the majority of that air will be drawn into intake 125, the two air flows may be treated differently. The air entering into intake 125 may be removed from the system, and the air entering intake 130 may be recirculated. This embodiment will assist in maintaining the general room pressure in which the dispensing station is located by retaining some air circulating through the system.

Figure 4:
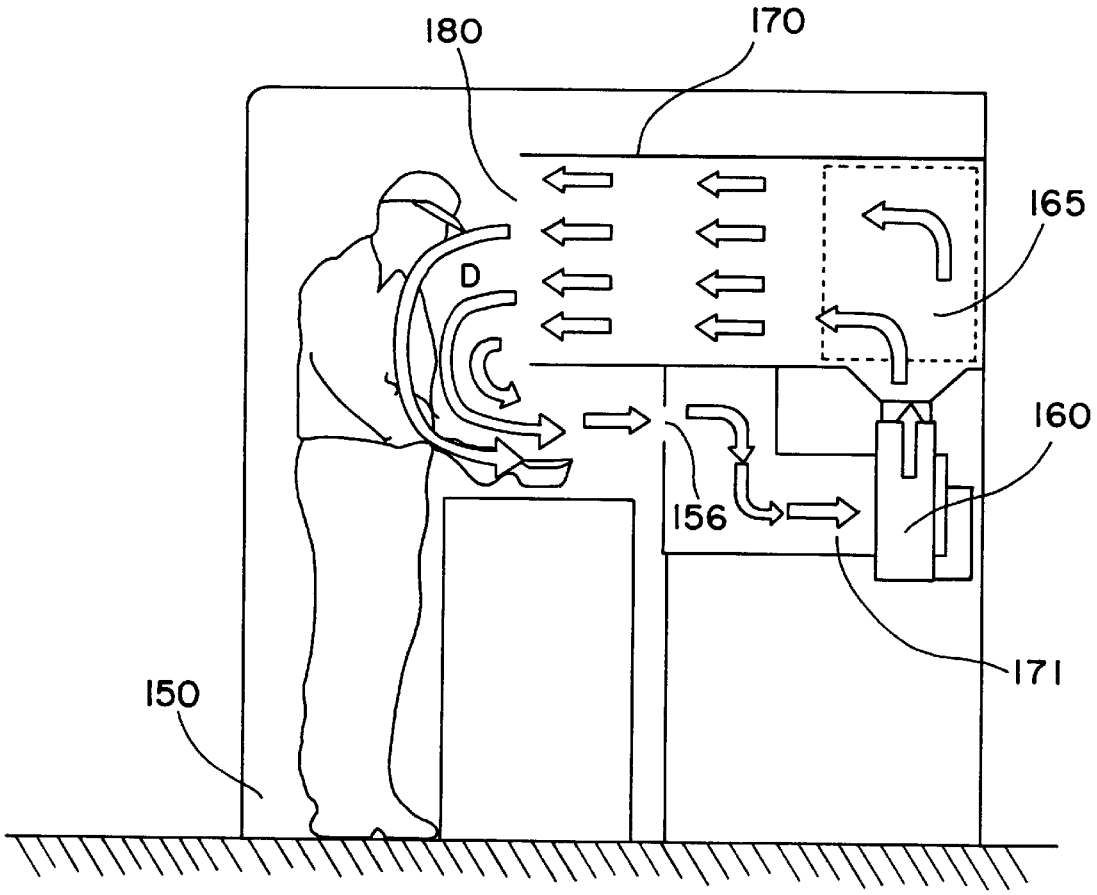
FIG. 4 is a cross sectional view of another preferred embodiment.

FIG. 4 shows yet another embodiment of the present invention. Wall 150 sets off the dispensing station from the room. Airflow in duct 170 passes through the ventilator 180 providing a face wash, and through the zone D above the containers. It then is carried into intake 156, with its local exhaust, and passes via duct 171 to fan 160. After passing through the fan 160, the air travels through filter 165, which in this embodiment is a HEPA filter, where the air is cleansed and passed again through duct 170 and out the system.

As with all the embodiments of the present invention, variations are possible which are within the spirit and scope of the appended claims. For example, the use of a full wall as described above to isolate the local area may include moveable and modular panel construction, so that panels and roof of the work station may be changed or eliminated if desired. Additionally, partial side walls, no side walls, partial or no roofs, and partial or no back walls, permanent or moveable, may be used in order to isolate the local area, instead of a deep booth structure described above with reference to some preferred embodiments.

In other embodiments, of course, a greater or lesser velocity of the air flow or flows may be desirable, depending upon the degree of control desired. Factors which may be used to determine the rate, include, inter alia, the nature and potency of the chemicals being manipulated, as well as the air pressure of the room in which the dispensing station is located.

It also may be desired to increase the volume of air supplied in the local dispensing station which effectively elevates the local pressure above the normal room pressure. This differential may be in some embodiments on the order of 20 pascals. This would be in order to keep extraneous material out of the local area. Alternatively, the volume of air supplied, and therefore, pressure could be decreased, if it was desired to keep material within the workstation.

In the event an embodiment is desired to be used which varies the air pressure locally, it should be noted that this must be done so as not to upset the room HVAC system. The room HVAC system is responsible for maintaining the room air pressure, therefore, whatever effect the work station has upon the room air pressure must be calibrated to fit within the existing room HVAC system in most embodiments. In some embodiments, if desired, the air flow requirements of the work station may require modifications of the room HVAC system. This is because this work station embodiment may exhaust elsewhere, for example.

Additionally, additional filters in series may be added. For example, it may be desired to prefilter the material, by way of a hi efficiency cyclone separator filter known in the art, before the air enters the fan. This would reduce the dust load on HEPA filters and prolong their life. Multiple HEPA or other filters may also be used in series.

The above description and the views and material depicted by the figures are for purposes of illustration only and are not intended to be, and should not be construed as, limitations on the invention. Moreover, certain modifications or alternatives may suggest themselves to those skilled in the art upon reading of this specification, all of which are intended to be within the spirit and scope of the present invention as defined in the attached claims.

What is claimed is:

1. A method for controlling air contamination over a local area comprising the steps of:

directing a first laminar flow of air with a velocity of from 125 to 250 feet per minute into an operator's localized breathing area;

directing a second laminar flow of air above and behind an operator;

exhausting both said first and second laminar flows away from an operator;

filtering said flows utilizing a HEPA filter; and, recirculating said flows.

2. An apparatus for controlling air contamination over a local area comprising:

means for directing a first laminar flow of air with a velocity of from 125 to 250 feet per minute into an operator's localized breathing area;

means for directing a second laminar flow of air above and behind an operator;

means for exhausting both said first and second laminar flows away from an operator;

means for filtering said flows further comprising a HEPA filter; and, means for recirculating said flows.

* * * * *